US005915291A

United States Patent [19]

Weihrauch et al.

[11] Patent Number: 5,915,291

[45] Date of Patent: Jun. 22, 1999

[54] REACTIVE BALLISTIC PROTECTION DEVICE

[75] Inventors: Günther Weihrauch, D-Blasingen; Erich Wollmann, Weil am Rhein; Klaus Sterzelmeier, Eimeldingen, all of Germany

[73] Assignee: Deutsche-Franzosisches Forschungsinstitut Saint-Louis, Saint Louis, France

[21] Appl. No.: 07/594,439

[22] Filed: Sep. 28, 1990

Related U.S. Application Data

[63] Continuation of application No. 07/241,233, Aug. 24, 1988, abandoned.

[30] Foreign Application Priority Data

Sep. 4, 1987 [DE] Germany ..... 37295926

[51] Int. Cl.[6] ..... F41F 1/02

[52] U.S. Cl. ..... 89/36.01; 89/8; 124/3

[58] Field of Search ..... 89/8, 36.17, 41.03, 89/41.05, 41.06, 41.07; 124/3

[56] References Cited

U.S. PATENT DOCUMENTS

| | | | |
|---|---|---|---|
| 4,432,333 | 2/1984 | Kurherr | 89/8 |
| 4,562,769 | 1/1986 | Heynau et al. | 89/41.06 |
| 4,765,244 | 8/1988 | Spector et al. | 89/41.03 |
| 4,791,850 | 12/1988 | Minovitch | 89/8 |
| 4,817,494 | 4/1989 | Cowan | 89/8 |
| 4,939,976 | 7/1990 | Minovitch | 89/8 |

FOREIGN PATENT DOCUMENTS

| | | | |
|---|---|---|---|
| 673414 | 1/1930 | France | 124/3 |
| 2410363 | 9/1975 | Germany | 89/41.05 |
| 2460507 | 7/1976 | Germany | 89/8 |
| 448496 | 6/1936 | United Kingdom | 124/3 |

OTHER PUBLICATIONS

Igenbergs et al, "The TUM/LRT Electromagnetic Launchers", IEEE Transactions on Magnetics, vol. MAG–22, No. 6, Nov. 1986, pp. 1536–1541.

McKinney et al, "Multiple Stage Pulsed Induction Acceleration", IEEE Transactions on Magnetics, vol. MAG–20, No. 2, Mar. 1984, pp. 239–242.

*Primary Examiner*—Charles T. Jordan
*Assistant Examiner*—Matthew J. Lattig
*Attorney, Agent, or Firm*—William L. Feeney; Kerkam, Stowell, Kondracki & Clarke, P.C.

[57] ABSTRACT

The protection device according to the invention comprises a primary and a secondary coil facing each other. Current flow through the primary coil induces magnetic fields which repel each other, so that the two coils are jerked apart and a missile is projected towards an approaching projectile. The projecting device is triggered by a sensing device.

By offsetting the magnetic fields of the primary and secondary coil, the angle between the direction of acceleration of the missile and the coil plane may be changed, as required.

Preferably, the primary coil comprises several offset coil elements, which can be activated separately, in groups or all together, as desired.

11 Claims, 3 Drawing Sheets

REACTIVE BALLISTIC PROTECTION DEVICE

This is a Continuation of application Ser. No. 241,233, filed Aug. 24, 1988 abandoned.

The present invention concerns a reactive protection device against projectiles as described in U.S. patent application Ser. No. 177,517 filed Apr. 8, 1988.

The reactive protection device uses an electromagnetic projecting device with a missile which is accelerated towards an approaching projectile. The missile is accelerated with the use of an assembly composed of one primary and one secondary coil which are stacked and mounted to the bottom of the plate-shaped missile in such a way, that the axis of this coil arrangement corresponds with the direction of acceleration of the missile. The term "direction of acceleration" as used here does not mean the accurate acceleration vector, but generally any direction pointing away from the armor to be protected.

The projecting device is triggered by a power supply producing a very high current which is conducted through the primary coil, leading to the induction of a current in the shorted secondary coil in such a direction, that the magnetic fields of the primary and secondary coils repel each other violently, thereby accelerating the missile. The missile may either be attached to one of the two coils or designed as a coil.

The current is supplied to the projecting device by the triggering of a power supply, e.g. a bank of capacitors, by a coordinating system which is connected to a sensing device for the early detection and identification of an approaching projectile.

The type, velocity and direction of an approaching projectile are determined in order to find out whether the projectile will probably impact on the object to be protected, which projecting device will have to be triggered eventually in order to render the projectile ineffective, and whether the hazard presented by the projectile requires the use of the projecting device at all.

Whereas with earlier active and reactive protection devices used to protect an object such as a tank it was necessary to cover the entire exposed surface of the tank, with some areas remaining unprotected, the protection device designated at the beginning is able to also protect areas in front of it by intercepting those projectiles threatening to impact there, before they even reach these areas. Thus it is possible, e.g. in the case of a tank, to protect the chassis, too, since the area to be protected does not have to be covered by active armor as it had to be before.

In order to achieve the required high sectional density in the case of kinetic energy (KE) projectiles, long pin-type projectiles are used at times. If such a KE projectile approaches the protection device in a direction approximately coinciding with the direction of acceleration of the protection device missile this missile will be penetrated without substantially affecting the in-flight stability of the KE projectile. However, if such a KE projectile approaches in a direction normal to the direction of missile acceleration and is hit by this missile, the in-flight stability of the projectile is affected insuch a way, that the projectile tumbles and is thus rendered incapable of penetrating the armor protected by the protection device.

Taking these conditions into consideration, the invention is based on the problem of developing the protection device mentioned at the beginning in such a way that a single protection device will be able to protect even larger areas of an object, such as the armor, equipped with this protection device, than the device mentioned at the beginning was capable of protecting, without those areas actually being covered by the device.

In addition, the protection device according to the invention is required to interfere even more efficiently with long pin-type KE projectiles.

This problem is solved by the features according the present invention.

According to the invention, the projecting device may not only be activated by the magnetic fields of the primary and secondary coils in such a way, that the missile is accelerated along the common central axis of these two coils, but activation may also be such that the magnetic fields of the two coils are slightly offset or inclined towards each other. In this case, activation of the primary coil does not only result in the mutual repulsion of the two coils due to their magnetic fields, but also in the tendency of the non-stationary coil to center with regard to the stationary coil, so that the missile is accelerated in a direction pointing away from the protection device as well as normal to this direction.

This transverse acceleration allows for the protection of additional object areas as against those protected by missiles which can only be projected in a direction normal to the surface of the object, the additional areas being those which will be reached if the missile is projected at an angle to the surface of the object. Thus, when a particularly long, pin-type KE projectile, that has been identified as such by the sensing device and coordinating system, approaches, a protection element with a missile preferably projected normal to the direction of flight of the projectile can be triggered. If the direction of approach of the projectile is practically normal to the object to be protected and to the protection elements, then the transverse acceleration of the missile of the protection device according to the invention renders possible the collision of the projectile with such a missile that does not only move towards but also transverse to the projectile, thus deflecting the projectile or causing it to tumble and turn over. Such interference is sufficient to prevent penetration of an object to be protected, preferably a tank, by a KE projectile of the above-mentioned type.

In principle, the stationary part of the coil assembly could be mounted to be mechanically movable, so that, immediately prior to the triggering of the projecting device, this part which originally was coaxial with the non-stationary part, could be offset and locked in this position, e.g. by a field magnet and a locking device. The disadvantages of such a configuration are the great engineering effort and the problem of these offsetting and locking devices for the stationary part having to withstand extremely high loads, i.e. exactly those forces effecting the transverse acceleration of the missile.

Therefore, preferably one of the coils, preferably the primary coil, is composed of at least two coil elements, the axes of which are offset or inclined towards each other and which can be triggered separately.

Assuming that one of the coils is composed of only one coil element with a single central axis, or of several elements (grid configuration) with several parallel equidistant central axes, all of the corresponding coil elements of the mating coil are preferably offset symmetrically with respect to the corresponding central axis. If current is applied to all the coils simultaneously now, the individual transverse accelerations cancel out and the missile will be accelerated in a direction practically normal to all coils. Selective connection and disconnection of individual offset or inclined coils, as required, allows for the achievement of a large number of different angles and velocities of departure of the missile.

This configuration also allows for the application of different currents to the individual elements of the primary coil, so that the angle of departure of the missile can be effected even further.

The secondary coil could be composed of different offset or inclined elements which could be opened or closed by opening or closing of the applicable element a measure allowing for offset or inclined arrangement of the magnetic field of the secondary coil with respect to that of the primary coil, in order to achieve transverse acceleration of the missile.

In principle, circular coil elements could be combined to form one coil, the possible particular advantage of such a configuration being that by the radially symmetrical deviations of the central axes of these coil elements from the central axis of the mating coil (primary or secondary) a large number of different solid angles of missile departure may be obtained. The disadvantage of such a configuration lies in the fact, though, that only a very small part of the magnetic field effects the transverse acceleration, so that the achievable transverse acceleration is relatively small. According to a further preferred embodiment of the invention, it is therefore suggested to use oblong, preferably rectangular coil elements, the sides of which are parallel. The elements are to be offset transversely with regard to their longitudinal axes. This means that the achievable angles of departure of the missile are all in a plane transverse to the sides of the coil elements, but relatively large deviations from the perpendicular to the coil element plane may be achieved, so that the use of such a protection device according to the invention, e.g. when the device is mounted on the front of a tank, allows for covering and protecting nearly the entire vehicle front including the chassis as well as the target acquisition, sighting and lighting equipment attached to the vehicle front.

As mentioned above,the primary coil as well the secondary coil can be stationary, and either one may be composed of several elements which are offset or inclined towards each other.

Each of the possible combinations of coils/elements has its own preferred and particularly useful field of use:

When a missile is used which forms a secondary coil, i.e. particularly a grid assembly as described in the secret U.S. patent application Ser. No. 199,925 filed May 6, 1988, the contents of which is integrated fully in this description by referring to it, a stationary primary coil composed of several offset elements is the most advisable.

On principle, such a grid assembly may also be composed of two grids with variable offset or a fixed offset from the central axis of the primary coil, e.g. when the initial objective is only a single, but oblique direction of missile projection.

Also, the missile may be composed e.g. of two grids, which can be nested in different positions, so that the direction of projection can be adjusted separately for each individual protection element to which such a missile is attached.

In addition, several stacked missiles to which the primary coil is attached may be used with a provision for applying current to one missile or several missiles simultaneously or consecutively. Thus, e.g. a tandem projectile can be countered effectively.

This allows for the primary coil to be composed of offset and inclined individual coil elements which may be triggered with the use of plug-in or sliding contacts in such a way that different directions of projection will be achieved. Thus, e.g. for the countering of a tandem projectile, two missiles having different directions of acceleration can be projected towards the tandem projectile in rapid succession, so that the first and the follow-up projectile forming the tandem projectile can be interfered with and engaged, respectively, more or less at the same time.

When the above-mentioned capability is not made use of, the secondary coil, stationary in this case, may be composed of several individual coil elements such as copper hoops with a curved hoop element which can be made to come into and to be out of contact with the ends of the mating split copper hoop, e.g. by using an electromagnetically controlled slider.

The desired transverse acceleration of the missile can be achieved even when there is a substantial distance between the primary and secondary coils as is unavoidable in some applications, e.g. in the case of several stacked missiles.

A further preferred embodiment of the invention allows for a particularly high transverse acceleration, though: In this embodiment, the secondary coil is designed as a hollow frame, the cavity of which faces the primary coil to receive this coil which is composed of several offset coil elements. In addition, the inside configuration of the hollow frame preferably attached to the missile may be used for guiding the missile being accelerated in order to prevent excessive transverse acceleration of the missile.

As a whole, the invention allows for sufficient protection of the top of a low flat armored vehicle, for instance with a single protection device equipped with a missile, e.g., a narrow grid, extending over the entire width of the vehicle. This protection device is able to protect the entire top of the vehicle, since the grid of the protection device according to the invention can be projected not only vertically upwards, but also at an angle forwards and backwards. For such a vehicle, a protection device attached in front of or above the chassis suffices to protect the entire front area against frontal attacks.

The subject of the invention is illustrated further by the examples shown in the accompanying schematic diagrams as follows.

Figure 1:
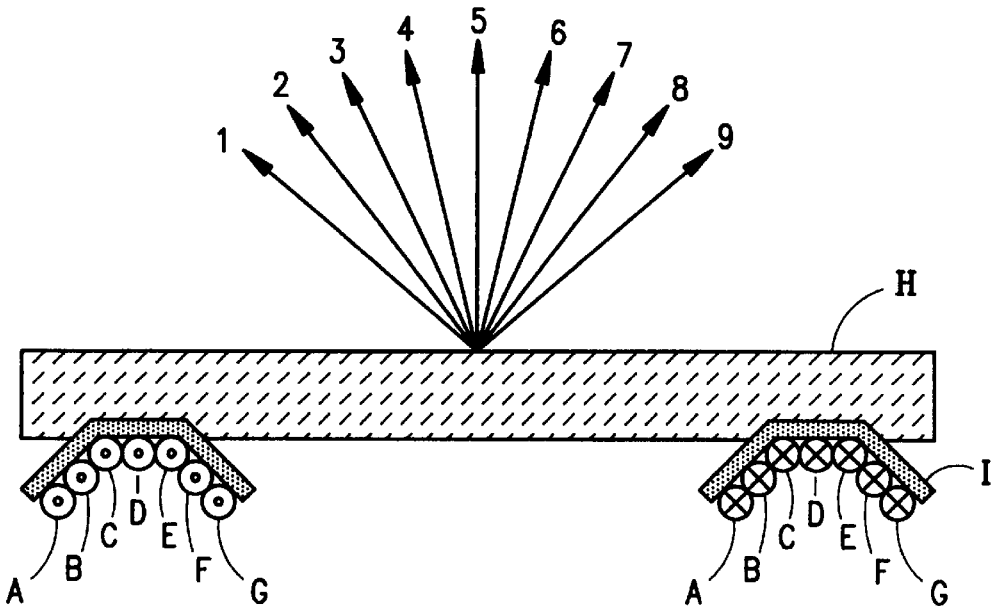
FIG. 1 shows the cross-section of a protection device according to the invention.
Figure 2:
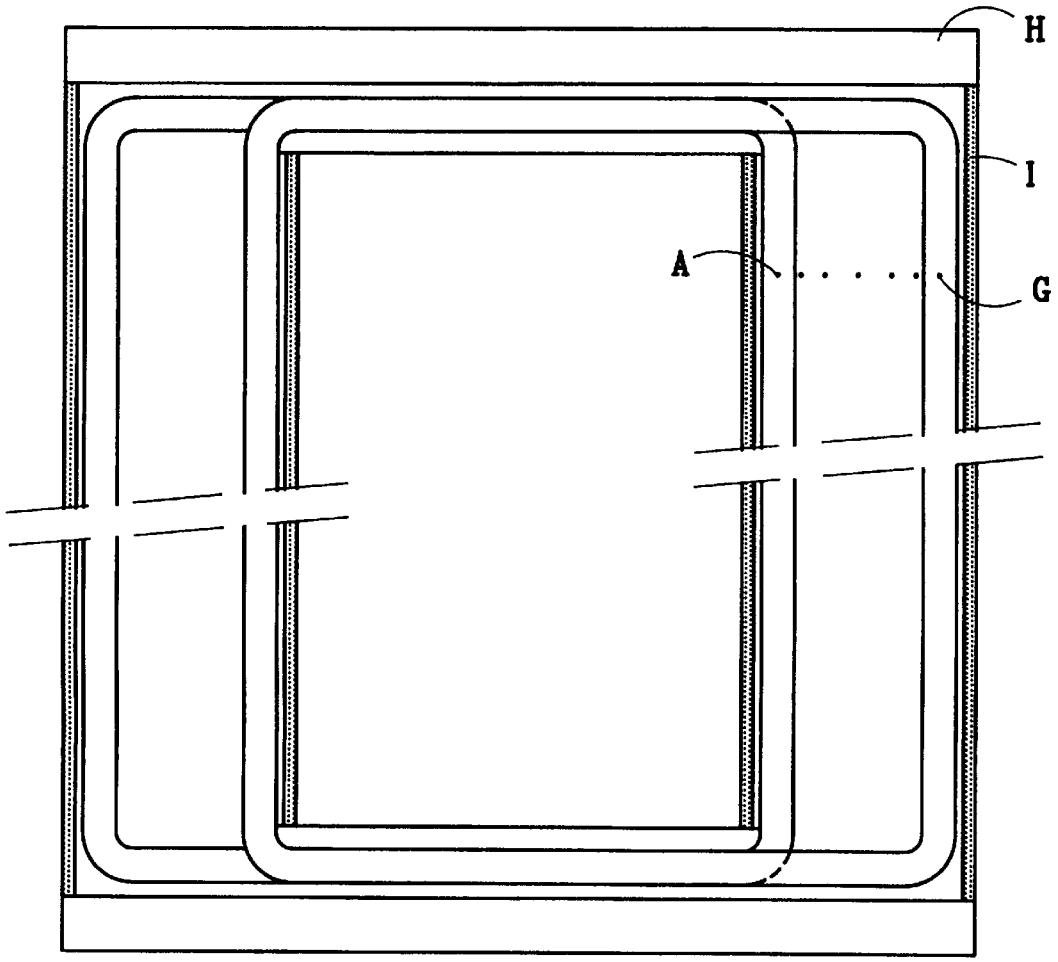
FIG. 2 shows the underside view of the protection device shown in FIG. 1.

The first embodiment of the invention shown in FIGS. 1 and 2 comprises a stationary primary coil which is composed of the individual coil rings A, B, C, D, E, F and G. These individual rings or turns serve as a direction control means by controlling missile direction depending on their activation. Alternately, such means could be the field magnet and locking device discussed above.

As shown in FIG. 2, each of these coil elements comprises a coil former designed as a rectangular frame. Although the cross-section of the conductors forming the coil elements is shows as circular, it is pteferably rectangular to avoid gaps as far as possible.

On top of the primary coil there is the secondary coil I, which is designed as an oblong rectangular frame made of highly conductive metal. The two side bars of this frame are hollow their cross-section being a regular trapezoid without the base. The individual coil elements lodge against the inside of these frame side bars, in order to ensure a minimum distance between the frame forming the secondary coil I and the corresponding primary coil element section A to G.

Figure 5:
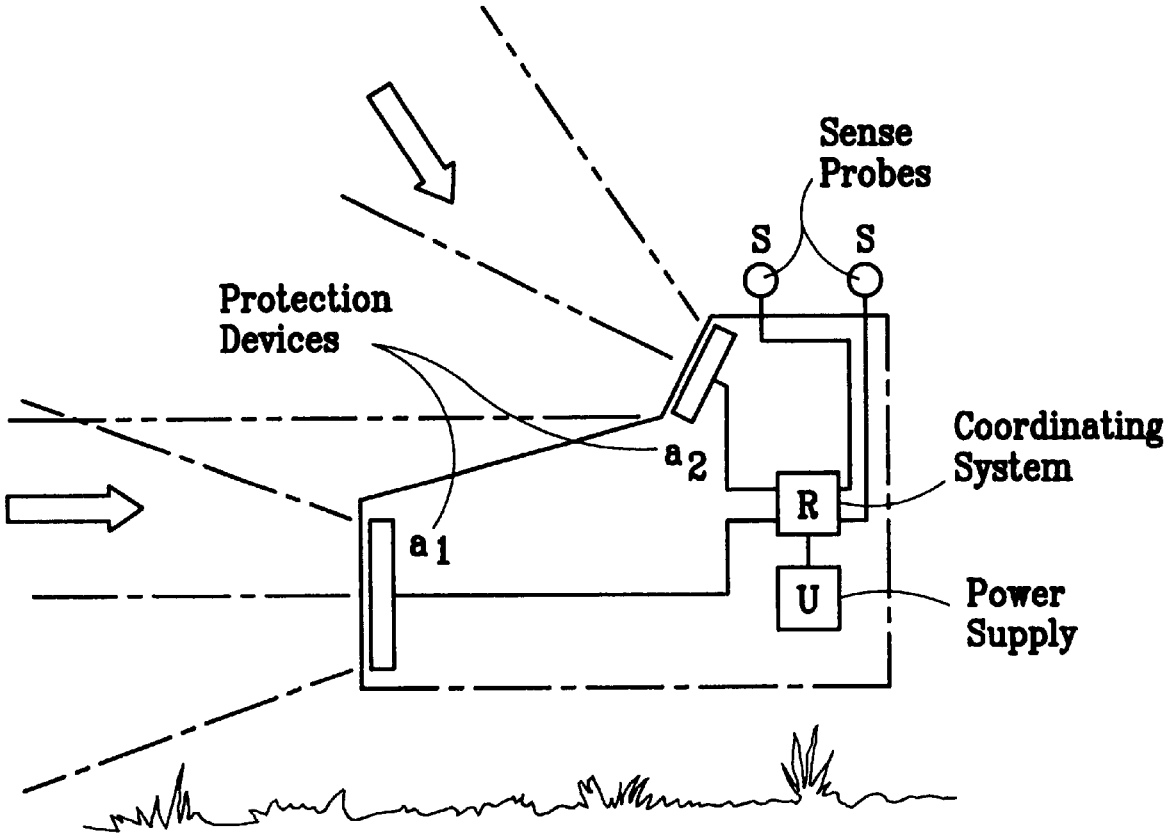
FIG. 5 shows the schematic profile of the front part of an armored vehicle equipped with two protection devices according to the invention.

The individual coil elements A to G may be connected to a power supply U, such as a bank of capacitors either separately or in groups, as desired, via a coordinating system R which is triggered by sensing probes S (the primary coil elements are shown in FIG. 5).

The frame-type secondary coil I is firmly attached to a plate-shaped missile H, which is the protection element proper, and which, when projected towards an approaching projectile, is able to destroy or effectively interfere with that projectile.

The missile H my be made of any material which is particularly suited for the purpose, preferably ceramic material.

FIG. 1 also shows the directions of acceleration 1 to 9. If, e.g., the missile H is to be projected in direction 5 at low velocity, only coil element D will be connected to the power supply U; however, if the missile is to be projected at maximum velocity in direction 9, coil elements E to G will have to be triggered. Projection of the missile at medium velocity in direction 3 requires triggering of coil elements B to D etc.

The hollow frame sections of the secondary coil I are straight, as can be seen from FIG. 2. They may also be designed as e.g. an arc, though, with a maxim angle of 160° C.

Figure 3:
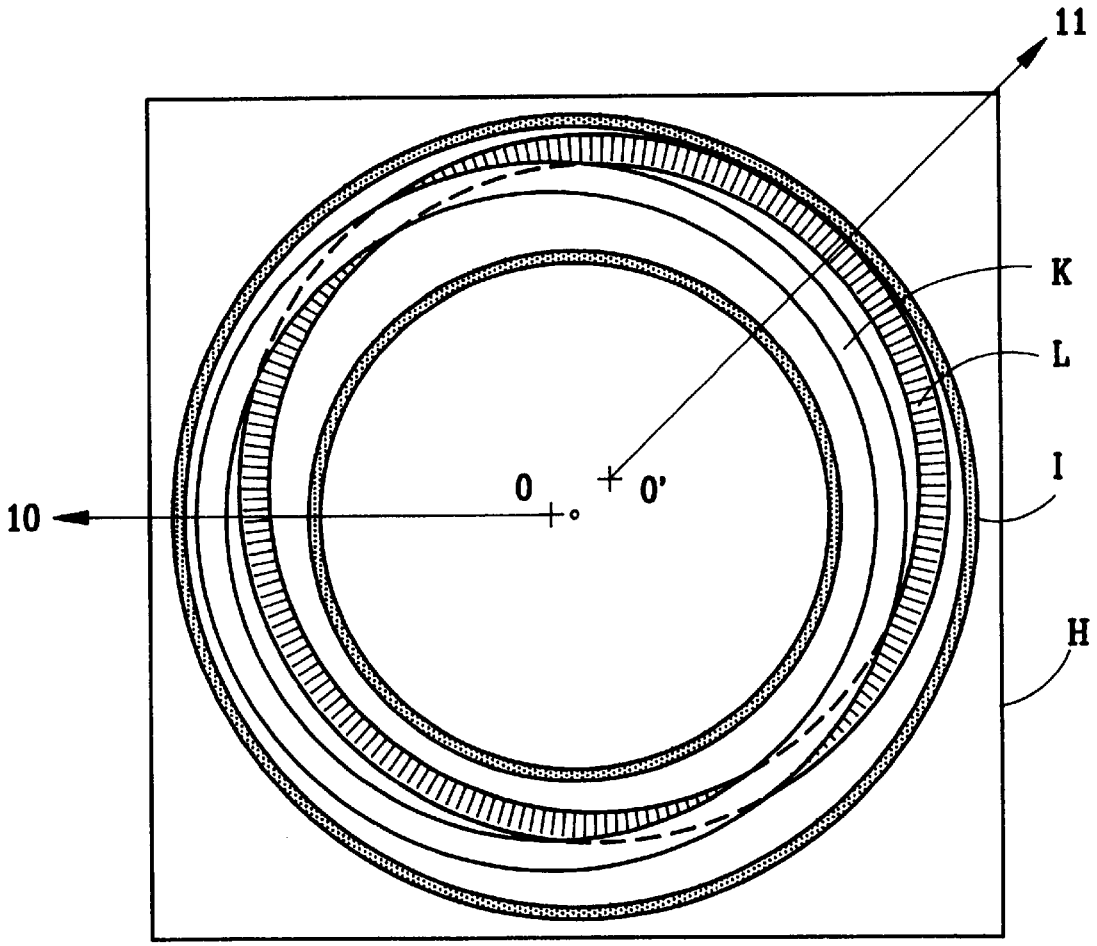
FIG. 3 shows the underside view of a further embodiment of the protection device according to the invention.
Figure 4:
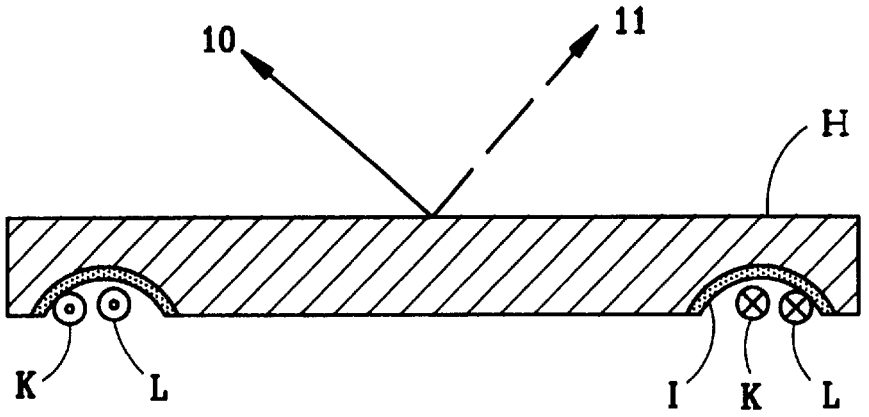
FIG. 4 shows the cross-section of the protection device shown in FIG. 3.

The embodiment shown in FIGS. 3 and 4 is a circular frame forming the secondary coil I. The frame contains two offset coil elements K and L which together form the primary coil. The trace of the axis of coil elements K and L in FIG. 3 is designated as 0 and 0', respectively.

If coil element K is connected to the power supply U, the missile H is project direction 10, and if coil element L is connected, the direction of acceleration is the one indicated by the arrow 11.

The embodiment may comprise further circular coil elements, which can be connected to the power supply separately, in groups or all together. The angle of inclination to be achieved between the direction of acceleration and the corresponding plane of the secondary coil is substantially smaller in the case of an oblong coil assembly as shown in the examples of FIGS. 1 and 2, than it is in the embodiment shown in FIGS. 3 and 4, assuming similar boundary conditions.

The cross-section of the circular frame forming the secondary coil I is an arc.

As shown in FIGS. 2 and 3, the coil elements or turns A to G and K and L are non-concentric, meaning that the central axes of each turn or element are offset from each other. The device with the primary and secondary coils form a pulsed induction acceleration system.

FIG. 5 shows the schematic profile of the front part of an armored vehicle equipped with two protection devices ($a_1$ and $a_2$) according to the invention.

Two sensing probes S, which are connected to a coordinating system R, are attached to the top of the vehicle. The coordinating system evaluates the sensing device data and determines the type of attacker approaching in the direction indicated by the arrows. The system ist also used to determine which of the two protection devices ($a_1$ or $a_2$) is to engage the attacker.

Since each of the two protection devices according to the invention ($a_1$, $a_2$) is able to project the missile not only normal to its transverse extension, but also at an angle, the suitable transverse acceleration for each missile is also determined, and on this basis the type and number of coil elements to be triggered. At the appropriate time, the coordinating system R provides the connection between the power supply U and the protection device ($a_1$ or $a_2$) to be used. The point of collision of the missile with the projectile is selected such, that the projectile is not only slowed down by the missile and has to penetrate it, but it is also deflected from its trajectory if possible, and tilted with respect to a transverse axis through its center of gravity.

In case of the two threats shown in FIG. 5, the intercept points suitable for the missiles of the protection device $a_1$ or $a_2$, are those marked by the tips of the arrows.

It has to be emphasized that each of the approaching attackers would impact on an area of the vehicle surface not equipped with a protection device, and that the protection device $a_1$ would not be able to engage the attacker the way it does, if it were able to project the missile in only one direction, i.e. normal to the device's longitudinal extension. But the protection device described above, extending in a mainly vertical plane, is able to protect the area immediately in front of it as well as the area in front of the chassis and forward above the inclined hood.

We claim:

1. A reactive protective device for protecting against projectiles comprising:

a power supply;

a sensing device for detection and identification of an approaching projectile;

a coordinating system for evaluating data from the sensing device; and an electromagnetic device receiving power from said power supply for acceleration of a missile towards the approaching projectile upon triggering of said electromagnetic device by said coordinating system; and wherein said electromagnetic device includes a primary coil for receiving power from said power supply by way of said coordinating system and a secondary coil disposed to be excited by said primary coil, wherein said electromagnetic device has direction control means for controlling direction of the missile and said electromagnetic device starts acceleration of the missile in a selected one of a plurality of directions from a stationary starting point as controlled by said direction control means when said secondary coil is excited by said primary coil, said one direction being determined by said direction control means controlling magnetic field interaction of said primary coil and said secondary coil, and wherein said coordinating system selects the one direction by using said direction control means to control the magnetic field interaction.

2. Device as claimed in claim 1, wherein the projecting device is formed for the production of magnetic fields offset in different directions depending on the triggering pulse, and including concentric fields.

3. Device as claimed in claim 1, wherein the primary coil comprises oblong coil elements.

4. Device as claimed in claim 1, wherein the primary coil comprises more than two elements and more than one element is selectively triggerable.

5. Device as claimed in claim 1, wherein the primary coil is stationary.

6. Device as claimed in claim 5, wherein the primary coil comprises several primary coils located side-by-side, and the secondary coil is formed as a grid and forms the missile.

7. Device as claimed in claim 1, wherein the secondary coil comprises a frame made of highly conductive material having bars, the bars of the frame being hollow on a side facing the primary coil for the purpose of receiving the primary coil.

8. The reactive protective device of claim 1 wherein said device is a pulsed induction acceleration system.

9. A reactive protective device for protecting against projectiles comprising:

a power supply;

a sensing device for detection and identification of an approaching projectile;

a coordinating system for evaluating data from the sensing device; and an electromagnetic device receiving power from said power supply for acceleration of a missile towards the approaching projectile upon triggering of said electromagnetic device by said coordinating system; and wherein said electromagnetic device includes a primary coil for receiving power from said power supply by way of said coordinating system and a secondary coil disposed to be excited by said primary coil, wherein said electromagnetic device starts acceleration of the missile in a selected one of a plurality of directions from a stationary starting point when said secondary coil is excited by said primary coil, said one direction being determined by magnetic field interaction of said primary coil and said secondary coil, and wherein said coordinating system selects the one direction by controlling the magnetic field interaction, and wherein said primary coil includes at least first and second turns which are non-concentric.

10. The reactive protective device of claim 9 wherein said first and second turns have parallel, offset axes.

11. A reactive protective device for protecting against projectiles comprising:

a power supply;

a sensing device for detection and identification of an approaching projectile;

a coordinating system for evaluating data from the sensing device; and an electromagnetic device receiving power from said power supply for acceleration of a missile towards the approaching projectile upon triggering of said electromagnetic device by said coordinating system; and wherein said electromagnetic device includes a primary coil for receiving power from said power supply by way of said coordinating system and a secondary coil disposed to be excited by said primary coil, wherein said electromagnetic device starts acceleration of the missile in a selected one of a plurality of directions from a stationary starting point when said secondary coil is excited by said primary coil, said one direction being determined by magnetic field interaction and said primary coil and said secondary coil, and wherein said coordinating system selects the one direction by controlling the magnetic field interaction, and wherein said primary coil includes a plurality of non-concentric turns, and wherein said coordinating system selects the one direction by selecting which of said turns power is supplied to.

* * * * *